US005460256A

United States Patent [19]

Levasseur

[11] Patent Number: 5,460,256

[45] Date of Patent: Oct. 24, 1995

[54] COIN SENSOR DEVICE

[75] Inventor: Joseph L. Levasseur, Chesterfield, Mo.

[73] Assignee: Coin Acceptors, Inc., St. Louis, Mo.

[21] Appl. No.: 220,790

[22] Filed: Mar. 31, 1994

[51] Int. Cl.[6] ..... G07D 5/02

[52] U.S. Cl. ..... 194/334; 250/223 R

[58] Field of Search ..... 194/334; 250/223 R

[56] References Cited

U.S. PATENT DOCUMENTS

| | | | |
|---|---|---|---|
| 3,797,307 | 3/1974 | Johnston | 73/163 |
| 3,797,628 | 3/1974 | Fougere et al. . | |
| 4,474,281 | 10/1984 | Roberts et al. | 194/334 X |
| 4,509,633 | 4/1985 | Chow . | |
| 4,646,904 | 3/1987 | Hoorman | 194/334 |
| 5,033,602 | 7/1991 | Saarinen et al. | 194/334 |
| 5,033,603 | 7/1991 | Kai et al. | 194/334 |
| 5,097,934 | 3/1992 | Quinlan | 194/334 X |

FOREIGN PATENT DOCUMENTS

| | | | |
|---|---|---|---|
| 3910824 | 11/1989 | Germany | 194/334 |

*Primary Examiner*—F. J. Bartuska
*Attorney, Agent, or Firm*—Haverstock, Garrett and Roberts

[57] ABSTRACT

A coin sensor device for determining the authenticity of a coin traveling along a predefined path including a first sensor device such as an optical sensor device located along the path, a second sensor device such as a second optical sensor device spaced a predetermined distance from the first sensor device along the path, the first and second sensor devices producing signal responses when a coin moves thereby, and a processing device connected to the first and second sensor devices for measuring two distinctive time intervals, the first time interval beginning when the trailing edge of the coin is sensed by the first sensor device and continuing until the trailing edge is sensed by the second sensor device, the second time interval beginning when the leading edge of the same coin is sensed by the second sensor device and continues until the trailing edge is sensed by the second sensor device, the processing device determining the ratio of the two time intervals and based on a determination of a predetermined ratio generating a signal to indicate the acceptability of the coin. The first and second sensor devices are preferably spaced along the predefined path such that certain large denomination coins will be able to simultaneously interrupt both the first and second sensor device and small denomination coins will interrupt the first and second sensor devices one at a time.

10 Claims, 4 Drawing Sheets

COIN SENSOR DEVICE

BACKGROUND OF THE INVENTION

This invention relates to a coin sensor device and more particularly to a coin sensor device and method for use with a coin-operated vending system for detecting undesired and counterfeit coins, slugs, and non-coin objects deposited or inserted into such systems and for distinguishing acceptable coins therefrom, and for determining or assisting in determinations of the denominations of the acceptable coins.

Coin-operated devices and systems of many types and variations are widely employed. For proper operation of such coin-operated devices and systems verifications means must be used to distinguish between acceptable and unacceptable coins and for discriminating between various denominations of acceptable coins. In many coin-operated devices in use today, coin acceptor means are provided for checking the dimensions of a deposited coin to determine whether or not such coin is of a proper size to be an acceptable coin. Most devices that perform such coin sizing checks make use of electrical or electronic means for determining or measuring coin dimensions. In order to check the dimensions of a deposited coin such means as a debouncer are used to settle or stabilize the coin as it passes by sensors. If the coin is not debounced it moves erratically by the sensors causing errors in discriminating between acceptable and unacceptable coins.

In the prior art there are many devices in existence that include sensors located to respond to movements of objects including coins. Some of the known devices measure or discriminate between objects or coins based on differences such as differences in coin size or diameter, and some employ sensors located at more than one elevation above the track or rail that the objects or coins move on, such for example, as the device disclosed in Kai et al U.S. Pat. No. 5,033,603. Other devices or sensors include means to illuminate coins or portions thereof as they move along the coin path usually by light sources oriented perpendicularly to the coin path. Such devices may employ photosensitive devices which convert changes in the light signals into electrical signals representative of some coin characteristic such as coin diameter. Typical of such devices is that disclosed in Saarinen et al U.S. Pat. No. 5,033,602.

Another coin sensing device is disclosed in Fougere U.S. Pat. No. 3,797,628 which discloses a coin selector which includes velocity determining means that operate on a chordal dimension of the coin. The device includes circuit means that compare resultant detected information with predetermined stored information that has characteristics that are considered to be representative of acceptable coins.

Another patent of interest is Johnston U.S. Pat. No. 3,797,307 which discloses a coin discriminator device which performs several different tests on each coin that passes and establishes values dependent on at least one of the tests.

Other patents of interest are Roberts et al U.S. Pat. No. 4,447,281 which discloses an apparatus for coin diameter computation and Chow et al U.S. Pat. No. 4,509,633 which discloses an electronic coin validator that includes diameter sensing means.

The present invention is distinguishable from the devices disclosed in the cited prior art by using two spaced sensors both located at or near the same predetermined height or distance above the track or rail along which coins travel on edge so that all coins moving along the track will be able to interrupt both sensors but for somewhat different time periods depending on the coin type or other characteristic such as coin diameter. In the present device both sensors will be interrupted in sequence by the leading edge of every coin, and both will reestablish the interrupted energy beam to the respective sensor across the feed path when the trailing coin edge moves past that sensor. The spacing of the sensors is important and is selected so that certain larger diameter coins, such as quarters, will be able to simultaneously effect or interrupt the beams of both sensors while smaller diameter coins, such as dimes, will be able to effect or interrupt only one sensor at a time. The time it takes for the leading edge of a coin to sequentially interrupt the beams of both sensors in sequence is an important time interval and depends on the speed of movement of the coin along the track. This time difference is used by circuit means such as by a microprocessor to make other determinations. The time when the trailing edge of a coin reestablishes the first beams is especially important because by that time any coin bounce that may occur when a coin lands on or falls on the track will have dissipated.

The present invention is for less affected by changes of the coins velocity during chordal and speed measurements since they predominately occur simultaneously, thereby achieving greater accuracy regardless of said changes.

The present construction provides a better, more accurate and relatively inexpensive coin sensing device, and one which provides an accurate way of identifying coins based by coin diameter. All this is made possible in a construction that has relatively few parts.

SUMMARY OF THE INVENTION

The present invention resides in a coin sensor device for determining the authenticity of a coin traveling along a defined path. The device includes spaced first and second sensor devices located along the path and responsive to predetermined movements of a coin thereby, and the device includes processing means connected to the first and second sensor means for measuring two distinct time intervals, the first time interval beginning when the trailing edge of a coin is sensed by the first sensor means and commencing until the trailing edge is sensed by the second sensor means, the second time interval beginning when the leading edge of a coin is sensed by the second sensor means and commencing until the trailing edge is sensed by the second sensor means. The present device also includes processing means for determining the ratio of the two time intervals and based upon this determination determining whether the coin is an acceptable coin or not.

OBJECT OF THE INVENTION

A principal object of the present invention is therefore to provide a device and method for use in a coin-operated vending system for distinguishing between acceptable coins and unacceptable coins deposited by customers.

A further object of the present invention is to provide a coin sensor device and method for identifying undesired and counterfeit coins, tokens, slugs, and non-coin objects, and for also determining or aiding in the determination of denominations of acceptable coins.

Another object is to provide coin sensing means which are relatively unaffected by erratic coin movements and coin bouncing.

Another object is to provide relatively inexpensive yet accurate means for sensing certain movements of objects such as coins and for distinguishing counterfeit objects or coins from genuine coins and for identifying the denominations of each acceptable coin.

A still further object of the present invention is to provide electronic means for differentiating various coins from one another on the basis of such coins differing physical dimensions.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
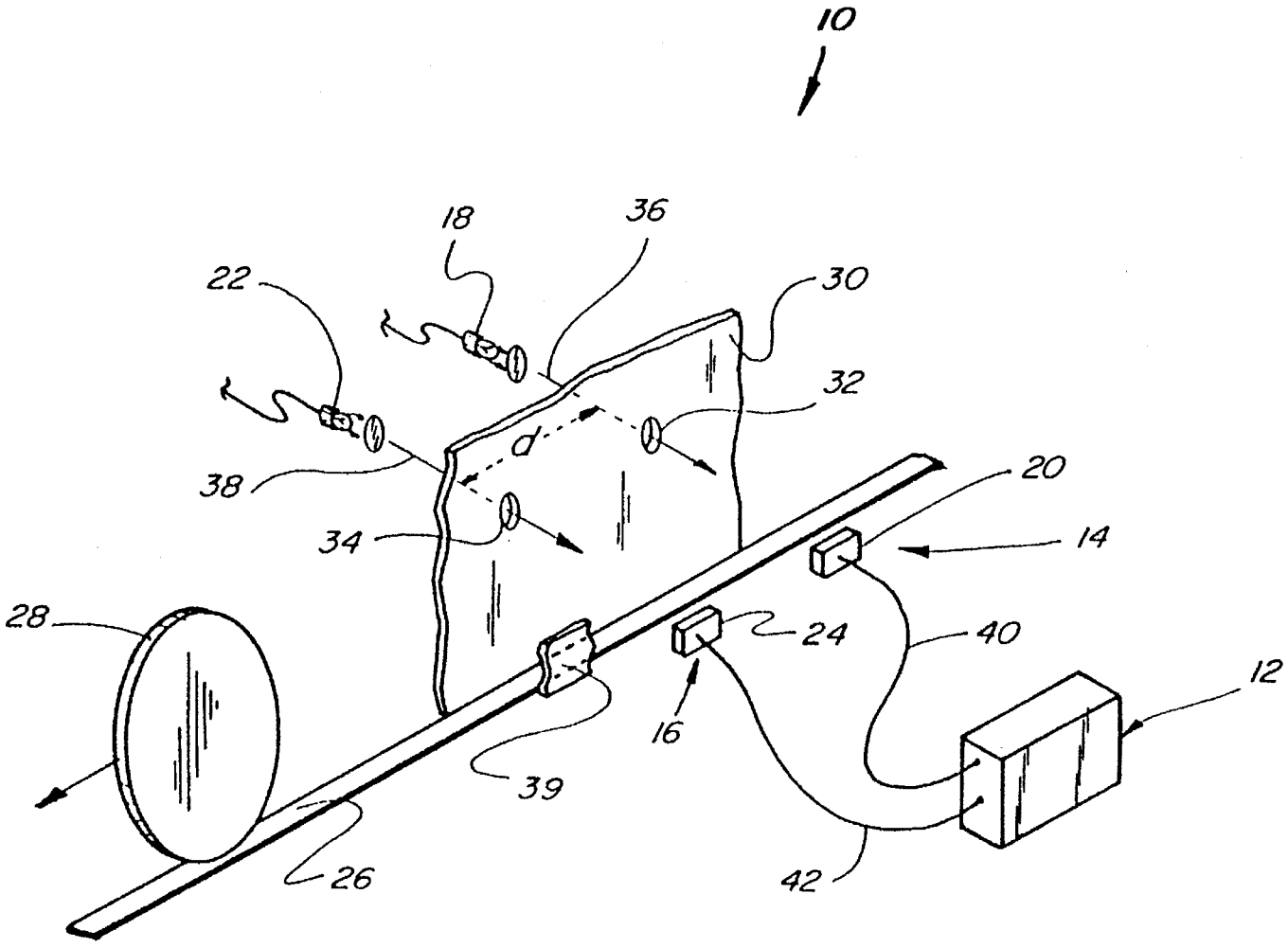
FIG. 1 is a partial perspective view of a coin track and associated sensor devices located at spaced locations therealong with a coin shown moving down the track.

Referring to the drawings more particularly by reference numbers, wherein like numbers refer to like items, number 10 in FIG. 1 refers to a coin sensor device constructed according to the present invention and including a processing means 12 operatively connected to first and second sensing means 14 and 16. In the preferred embodiment depicted, the sensing means 14 and 16 each comprise an energy or light source 18 and 22 and an associated sensor 20 and 24. The sensing means 14 and 16 may be optical couplers, each of which has a light emitting diode portion and a phototransistor portion.

In a typical coin acceptor means, coins move along an inclined coin rail 26 in a manner similar to that depicted by coin 28 in FIG. 1. The sensing means 14 and 16 of the present invention are positioned in a spaced relationship along the coin rail 26 in such positions that as coins, ranging in size from the smallest acceptable coin to the largest acceptable coin, move along the coin rail 26 they pass the sensing means 14 and 16 in order. The light sources 18 and 22 are installed in spaced relationship along one side wall 30. The side wall 30 has a pair of openings 32 and 34 through which respective focused light beams 36 and 38 from each of the light sources 18 and 22 is projected. The sensors 20 and 24 are positioned in a spaced relationship along the coin rail 26 along another side wall 39 in FIG. 1 with openings similar to the openings 32 and 34.

For purposes of the present invention, a large diameter coin is considered to be a coin whose diameter is greater than the spacing d between the sensing means 14 and 16 and a small diameter coin is considered to be coin whose diameter is less than the spacing d. FIGS. 2A–2D depict the movements of a coin of relatively large diameter, such as a U.S. quarter or larger coin past the sensing means 14 and 16 while FIGS. 4A–4D depict the movements of a coin of relatively small diameter, such as a U.S. dime past the sensing means 14 and 16. FIGS. 6A–6D show the same device with a nickel coin moving along the rail 26.

Referring again to FIG. 1, it will be appreciated that, in the absence of any coin at the location of the sensing means 14 and 16, the focused light beams 36 and 38 pass through the openings 32 and 34 and are detected by the associated sensors 20 and 24. The sensors 20 and 24 will be conducting and a high (or if desired a low) signal will be provided on leads 40 and 42 to the processing means 12. If a coin, such as coin 28, moves into a position between the light sources 18 and 22 and the associated sensors 20 and 24, such that the focused light beams 36 and 38 cannot be detected by the sensors 20 and 24, the sensors 20 and 24 will cease conducting and a low (or high) signal will be sent via leads 40 and 42 to the processing means 12. It will further be appreciated that the leading edge of a coin traveling down the coin rail 26 will sequentially occlude or block the focused light beams 36 and 38 and the leading edge of a coin may be detected by the transition of the signal provided to the processing means 12. Additionally, the trailing edge of a coin traveling down the coin rail 26 will sequentially unblock the light beams 36 and 38 and may be detected by transition of the signal provided to the processing means 12, as will be explained.

Figure 2A:
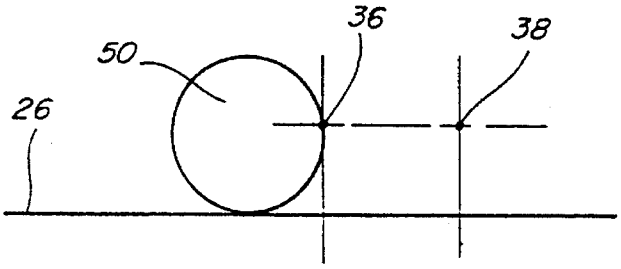
FIG. 2, consisting of FIGS. 2A–2D, shows predetermined movements of a larger coin passing the coin sensors according to the present invention.
Figure 2B:
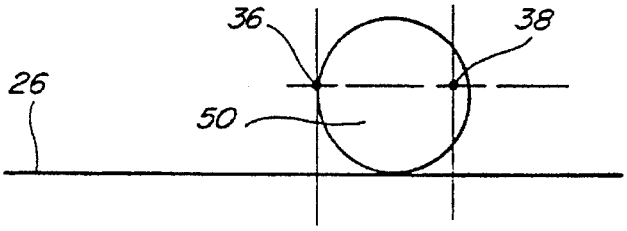
Figure 2C:
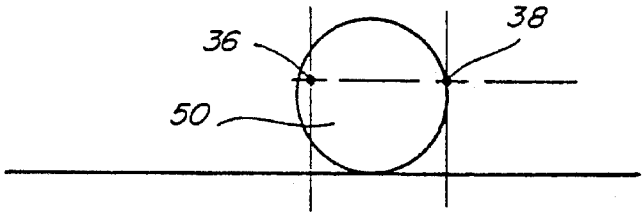
Figure 2D:
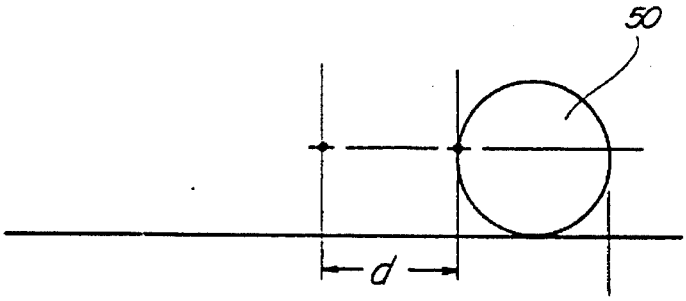
Figure 3:
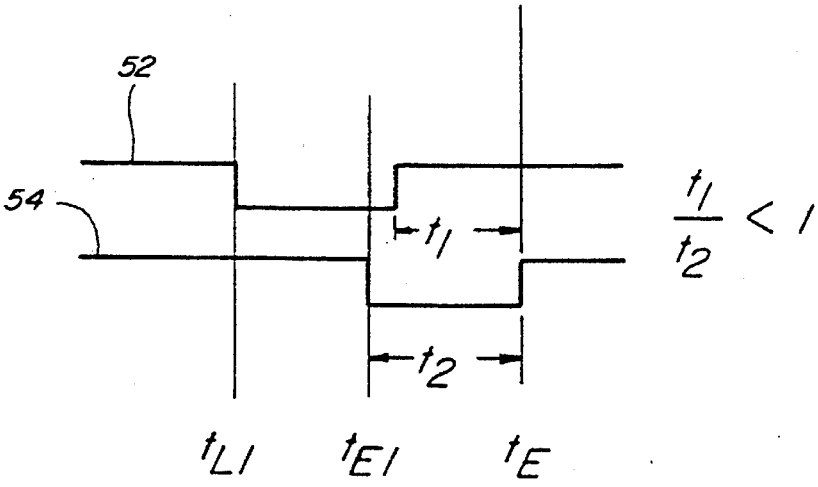
FIG. 3 is a timing diagram showing the status of the sensing means during the period of FIGS. 2A–2F.

When a large diameter coin such as a quarter moves past the sensing means 14 and 16, as shown in FIGS. 2A–2D, signals such as those illustrated in FIG. 3 are produced on leads 40 and 42. Similarly, when a small diameter coin such as a dime moves past the sensing means 14 and 16, as shown in FIGS. 4A–4D, signals such as those shown in FIG. 5 are produced on leads 40 and 42.

Certain of the above discussed transitions mark the beginning or end of one of two distinct time periods used in determining acceptability and denomination of a coin as will be described in greater detail in connection with FIGS. 2, 3, 4, and 5. By calculating the time duration between an initial change in status of the sensing means 16 and the first subsequent change in status of the sensing means 14 and 16, it is possible to determine the acceptability and the denomination of the coin 28.

As noted above, two distinct time intervals are determined by the coin sensing device of the present invention as each coin passes the coin sensing means 14 and 16. The time intervals for a large diameter coin are depicted in FIGS. 2A–2D and transition signals 52 and 54 are illustrated in FIG. 3. When a large diameter coin 50, such as a quarter, passes the sensing means 14 in such a manner as depicted in FIG. 2A, the leading edge of the coin 50 begins to occlude the sensing means 14. Since this event is used only to start the timing sequence in the present invention and to establish an initial condition (high as shown) there is no detected change in the signal waveform 52 shown in FIG. 3. FIG. 2B represents the beginning of one of the two distinct time intervals which corresponds to the trailing edge of the coin 50 unblocking the first sensing means 14. This event is designated as $t_{L1}$ and is further illustrated in FIG. 3 as the transition of the waveform 52 from an initial state such as a low to a high state. FIG. 2C shows the beginning of the other one of the two distinct time intervals which corresponds to the leading edge of the coin 50 occluding the second sensing means 16. With reference to FIG. 3, this event is designated as $t_{E1}$ and is represented by the waveform 54 making the transition from its initially high state to a low state. Both of the time intervals end simultaneously when the trailing edge of the coin 50 is detected by the uncovering of the second sensing means 16. Again, with reference to FIG. 3, the ending of both of the time intervals is designated as $t_E$ and is indicated by the transition of the waveform 54 from its low state to its high state.

The time it takes for the trailing edge of the coin 50 to uncover the first sensing means 14 until the same trailing edge of the coin 50 uncovers the second sensing means 16 is designated as time $T_1$. This can also be described as the travel time. The waveform 52 therefore represents the travel time for the trailing edge of the coin 50 to pass between the sensing means 14 and 16. Waveform 54 represents a second time interval $T_2$ which corresponds to the time :from when the leading edge of the coin 50 covers the second sensing means 16 until the trailing edge of the coin 50 uncovers the second sensing means 16. The waveform 54 therefore is indicative of the chord of the coin 50 and this may be described as the chord time.

The ratio of the two time intervals $T_1/T_2$ is calculated by the processing means 12. If the calculated ratio is equal to some predetermined amount the processing means 12 indicates the denomination of the coin and that the coin is determined to be an acceptable coin. For a quarter coin the ratio $T_1/T_2$ is less than 1.

Figure 4A:
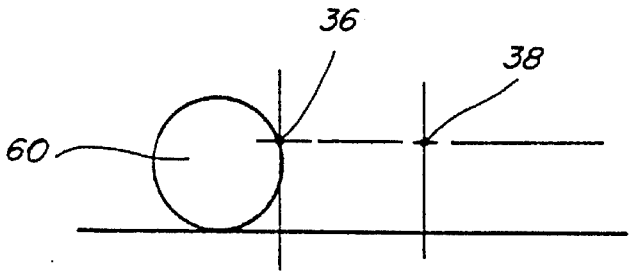
FIG. 4, consisting of FIGS. 4A–4D, shows predetermined movements of a smaller coin passing the coin sensors according to the present invention.
Figure 4B:
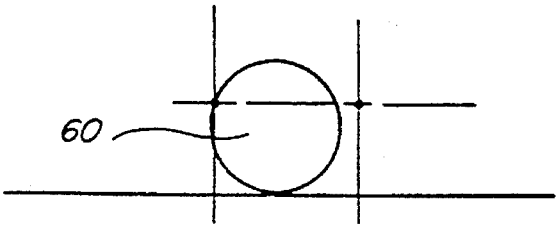
Figure 4C:
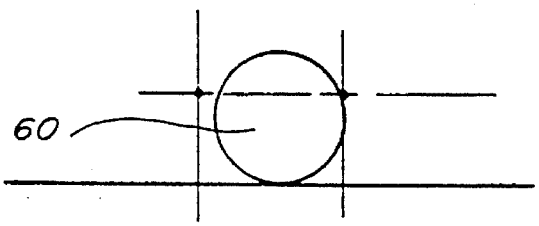
Figure 4D:
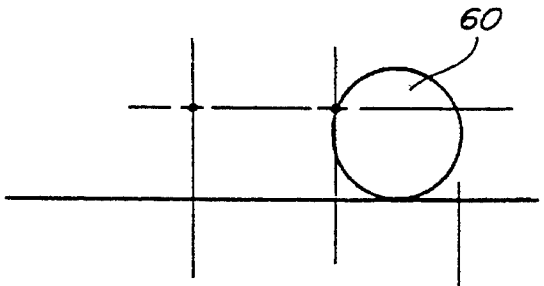
Figure 5:
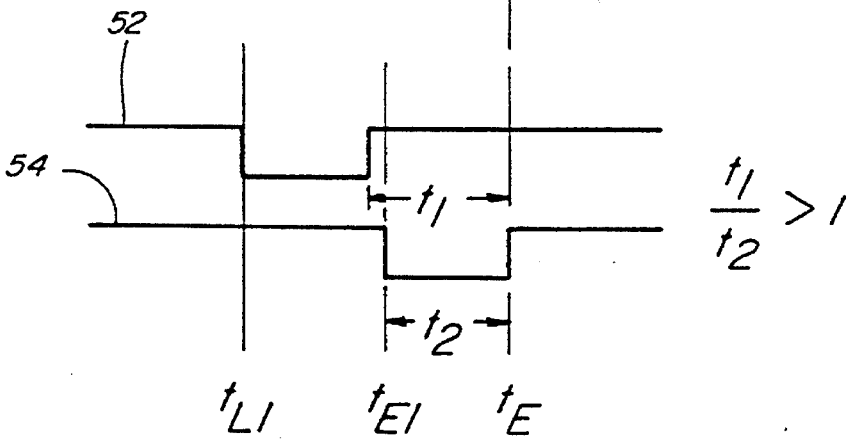
FIG. 5 is a timing diagram showing the status of the sensing means during the period of FIGS. 4A–4D.
Figure 6A:
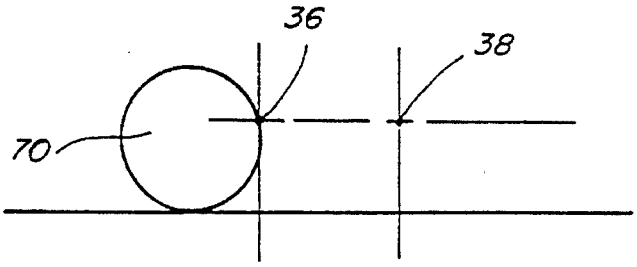
FIG. 6, consisting of FIGS. 6A–6D, shows predetermined movements in which a coin of an intermediate size is passing the coin sensors.
Figure 6B:
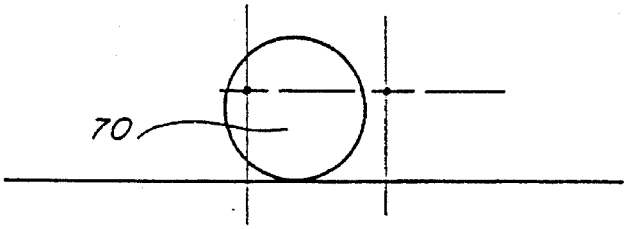
Figure 6C:
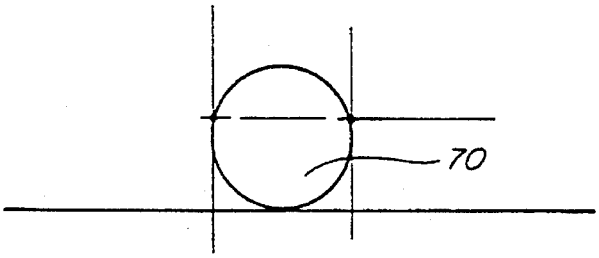
Figure 6D:
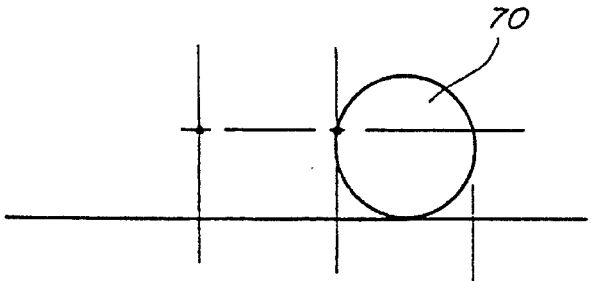

The time intervals for a small diameter coin are depicted in FIGS. 4A–4D and the corresponding transition signals are illustrated in FIG. 5. With reference now to FIG. 4A, when a small diameter coin, such as dime 60, passes the sensing means 14 as depicted it begins to occlude the sensing means 14. This conditions the device that a coin has arrived. Thereafter Fig. 4B represents the beginning of one of the two distinct time intervals which commences when the trailing edge of the coin 60 unblocks the first sensing means 14. This event is further illustrated in FIG. 5 by the transition of the waveform 52 of the first sensor going from a low state to a high state. FIG. 4C shows the beginning of the other or second distinct time interval which commences when the leading edge of the coin 60 occludes the second sensing means 16. With reference to FIG. 5, this is represented by the waveform 54 making the transition from a high state to a low state. Both of the time intervals end when the trailing edge of the coin 60 is detected by the uncovering of the second sensing means 16. Again, with reference to FIG. 5, the ending of both of the time intervals occur at the same time. For a dime the ratio $T_1/T_2$ is greater than 1.

The same ratio of the two time intervals is then calculated by the processor 12 as described above. However, since the dime coin is not able to cover both sensors 14 and 16 at the same time as in the case of a quarter coin, there is a gap between the time the two sensors 14 and 16 are interrupted. Otherwise the operation is similar to the operation described for a quarter. Thus in the case of the dime coin, the trailing edge reestablishes the first sensor 14 before it interrupts the second sensor 16 and thereafter the dime will interrupt the second sensor for a time period until its trailing edge reestablishes the second sensors 16. Here again the same signals are fed to the microprocessor 12 but in this case the ratio of the time intervals $T_2/T_2$ is greater.

Figure 7:
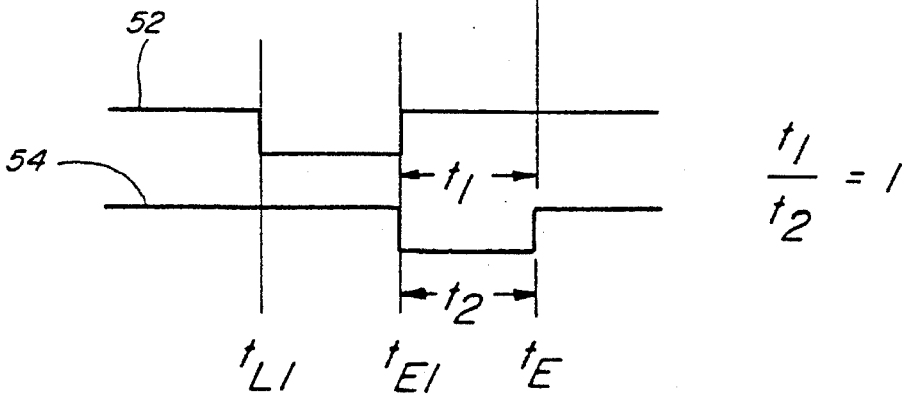
FIG. 7 is a timing diagram associated with the movement of the intermediate coin shown in FIG. 6.

In the case of a nickel coin 70 which is sized to establish the first sensor 14 at the same time that it interrupts the second sensor 16 the ratio will be exactly one, see FIGS. 6 and 7. Thus if a scale of digits is established for the ratio, the scale will indicate the type or denomination of the coin based on the ratio.

The present device is a relatively simple device that extracts information based on movements of coins along a rail and uses the information extracted after the coin has initially entered the area where the sensors are located to determine coin size and denomination. It does this after the coin has ceased to move erratically or to bounce.

Thus there has been shown and described a novel coin sensor device which fulfills all the objects and advantages sought therefor. It is apparent that many changes, modifications, variations and other uses in applications for the subject device are possible and all such changes, modifications, variations and other uses in application which do not depart from the spirit and scope of the invention are deemed covered by the invention which is only limited by the claims which follow.

What is claimed is:

1. A coin sensor device for determining authenticity of a coin traveling along a guide rail, the device comprising:

a first sensor means located along the guide rail at a point spaced along the guide rail from where the coin begins to roll on its edge;

a second sensor means, spaced a predetermined distance from the first sensor means along the guide rail;

processing means connected to the first and second sensor means for determining a ratio of two distinct time intervals, the first time interval beginning when the trailing edge of the coin is sensed by the first sensor means and continues until the trailing edge is sensed by the second sensor means, the second time interval beginning when the leading edge of the coin is sensed by the second sensor means and continues until the trailing edge is sensed by the second sensor means, the processing means including means for comparing the determined ratio with a predetermined value and if the comparison is satisfied generating an acceptance signal.

2. The coin sensor device of claim 1 wherein the first and second sensor means are optical sensors each having light producing means located on one side of the predefined path and light sensor means located on the opposite side of the predefined path.

3. The coin sensor device of claim 1 wherein the first and second sensors are spaced apart along the predefined path a distance such that large denomination coins will be able to interrupt both sensors simultaneously and smaller denomination coins will interrupt the sensors one at a time.

4. The coin sensor device of claim 3 wherein the first and second sensor means are spaced apart a distance equal to some predetermined intermediate sized coin.

5. The coin sensor device of claim 4 wherein the intermediate size coin is a nickel coin.

6. The coin sensor device defined in claim 1 wherein each of the first and second sensor means changes between a conducting and a non-conducting condition whenever an edge of coin moves past.

7. The coin sensor device of claim 1 wherein the first and second sensor means are optical couplers having a light emitting device on one side of the predefined path and a light sensitive device on the opposite side of the predefined path.

8. The coin sensor device of claim 7 wherein each of the first and second sensor means includes means for focusing the light produced by the associated light producing means into a beam extending transversely across the predefined path.

9. The coin sensor device of claim 1 wherein the predefined path includes a rail along which coins move, the first and second sensor means being located the same distance from the rail.

10. A coin sizing means for use in distinguishing between various coins as they travel along a guide rail comprising:

a pair of sensing means positioned at spaced locations along the guide rail to detect movements of a coin rolling on its edge past the sensing means, the sensing means producing responses representative of predetermined positions of a coin, and means responsive to said responses for producing a ratio of two distinct time intervals, the first time interval corresponding to the time it takes for the trailing edge of the coin to pass by both of the sensing means in said pair and the second time interval corresponding to the time it takes for the leading edge and the trailing edge of the coin to pass by the second one of the pair of sensing means;

the means for producing the ratio of the two time intervals including means for comparing the ratio with a predetermined value and if the comparison is satisfied generating a signal indicative of the acceptability of the coin.

* * * * *

UNITED STATES PATENT AND TRADEMARK OFFICE

CERTIFICATE OF CORRECTION

PATENT NO. : 5,460,256

DATED : October 24, 1995

INVENTOR(S) : Joseph L. Levasseur

It is certified that error appears in the above-indentified patent and that said Letters Patent is hereby corrected as shown below:

Column 2, line 52, "OBJECT" should be --OBJECTS--.

Column 5, line 15, ":from" should be --from--.

Column 5, line 61, "$T_2/T_2$" should be --$T_1/T_2$--.

Signed and Sealed this

Twentieth Day of February, 1996

*Attest:*

*Attesting Officer*

BRUCE LEHMAN

*Commissioner of Patents and Trademarks*